United States Patent [19]

Dowling et al.

[11] Patent Number: 5,029,605

[45] Date of Patent: Jul. 9, 1991

[54] FLUID VESSEL OVERFLOW SYSTEM

[76] Inventors: Donald C. Dowling, 206 Stevens Ave., Cedar Grove, N.J. 07009; Bruce Olsson, 54 Morningside Ave., North Haledon, N.J. 07508

[21] Appl. No.: 556,724

[22] Filed: Jul. 26, 1990

Related U.S. Application Data

[63] Continuation-in-part of Ser. No. 424,745, Oct. 20, 1989, abandoned.

[51] Int. Cl.[5] ..... F16K 31/02; F16K 51/00; H01H 35/18

[52] U.S. Cl. ..... 137/312; 122/504; 122/507; 126/344; 126/388; 137/392; 200/61.04; 200/61.05; 307/118; 361/178

[58] Field of Search ..... 122/504.2, 505, 507; 126/344, 374, 383, 388, 419, 423, 437; 137/312, 386, 387, 392; 68/208; 134/57 D, 58 D; 200/61.04, 61.05, 83 WM, 84 R; 73/313; 307/118; 340/604, 605, 620, 623, 625; 361/178

[56] References Cited

U.S. PATENT DOCUMENTS

| | | | |
|---|---|---|---|
| 2,428,466 | 10/1947 | Palm | 126/344 X |
| 2,456,698 | 12/1948 | Hall | 126/350 R |
| 3,063,432 | 11/1962 | Bond et al. | 122/504 |
| 3,069,671 | 12/1962 | Taylor | 122/504 |
| 3,770,002 | 11/1973 | Brown | 137/312 |
| 3,874,403 | 4/1975 | Fischer | 200/61.04 |
| 3,920,031 | 11/1975 | Maxfield | 137/312 |
| 4,380,243 | 4/1983 | Braley | 137/387 |
| 4,805,662 | 2/1989 | Moody | 137/392 |
| 4,909,274 | 3/1990 | Rodriguez | 137/312 |
| 4,944,253 | 7/1990 | Bellofatto | 126/374 |

FOREIGN PATENT DOCUMENTS

| | | | |
|---|---|---|---|
| 2806736 | 8/1979 | Fed. Rep. of Germany | 137/312 |
| 2823262 | 12/1979 | Fed. Rep. of Germany | 137/312 |
| 2947433 | 5/1981 | Fed. Rep. of Germany | 137/312 |

*Primary Examiner*—George L. Walton
*Attorney, Agent, or Firm*—Melvin K. Silverman

[57] ABSTRACT

There is provided a system for blocking the inflow of water to an appliance such as a hot water tank in the event of a leak in the appliance or water supply thereto. A low voltage current solenoid selectively blocks said inflow in response to a leak. No current is drawn during normal operation of the appliance.

8 Claims, 2 Drawing Sheets

FLUID VESSEL OVERFLOW SYSTEM

BACKGROUND TO RELATED APPLICATION

This case is a continuation-in-part of application Ser. No. 07/424,745, filed Oct. 20, 1989, entitled Water Vessel Overflow Control System, now abandoned.

BACKGROUND OF THE INVENTION

A long standing problem in the area of containers and conduits containing, in particular, hot water is that if a leak or break were to occur in the tank or conduit, no practical means or method exist for terminating the water input to the tank or conduit unless one is physically present at the time that the leak initiates.

The consequences of this problem is well known to the home owner, or tenant, who has experienced a burst hot water tank or a broken water supply through an apparatus making use of a hot water tank.

In the prior art, certain rudimentary efforts have been made to afford an automatic water cut off. Such prior art is reflected in U.S. Pat. No. 3,473,553 (1969) to Collins, entitled Water Cut Off Water Heaters; U.S. Pat. No. 3,920,031 (1975) to Maxfield, entitled Safety Shut Off Device; and U.S. Pat. No. 4,805,662 (1989) to Moody, entitled Hot Water Heater Failure Protection Device with Solenoid.

The structure of Collins is a purely mechanical device and, as such, does not make use of state of the art electromechanical components which are now available. Further, the device of Collins will not sense a leak which occurs at the lateral sides or top of a hot water tank.

The structure of Maxfield as in the case of Moody, operates only to sense accumulation of moisture or liquid below the tank, that is, in the so-called drip pan. Further, the solenoid thereof operates in a mechanical fashion which increases the possibility of failure over the extended time period that any vessel overflow control system must function.

The above reference to Moody makes use of a ground fault interpreter circuit which, for its operation, requires that the hot water heater failure system be continuously powered by a 120 volt alternating current. Accordingly, the system of Moody, while solving one problem, substitutes therefore a serious safety hazard which also has connected with it a considerable cost in power.

The instant invention addresses the long-felt problem of liquid vessel overflow control while overcoming the above set forth shortcomings of safety and cost in the prior art.

SUMMARY OF THE INVENTION

The present invention relates to a liquid vessel overflow control system. The system comprises a vessel having a liquid input and liquid output, said vessel having a top and bottom defined respectively by the gravity vector. The system further includes a fluid-tight housing peripherally surrounding said vessel about all surfaces other than said bottom to, thereby, form an insulation region between said vessel and said peripheral housing. The system yet further includes a liquid collection chamber formed integrally beneath said vessel and vessel housing, and in fluid communication with said insulation region. Thereby a leak or fracture of said vessel will result in an accumulation of liquid in said collection chamber, whether said fracture of the vessel occurs at the top, sides or bottom thereof. The system also includes a normally-open electrically actuatable fluid solenoid means disposed within said input of said vessel, said solenoid normally drawing no current. A liquid detection means is disposed within said liquid collection chamber, such detection mean comprising an element within an electrical circuit having electrical communication means disposed between said solenoid and said liquid detection means, said electrical circuit passing along the gravity-axis length of said insulation region, said liquid detection means further comprising a normally-open circuit. Resultingly, said liquid detection means will become a closed circuit responsive to a fixed level or density of liquid within said open circuit within said collection chamber, thereby permitting current to flow to said solenoid and actuating it to thereby block any further input of liquid to the vessel.

It is accordingly an object of the present invention to prevent leakage of water from a hot water vessel or other hot water conduit.

It is another object of the invention to terminate water input to a leaking hot water tank or conduit.

It is a further object to provide a system that will minimize the possibility of escape of water that has leaked from any water tank or water supply conduit.

It is a yet further object to provide a system of the above type that will operate with minimal use of power and that will not pose a safety hazard to persons in the vicinity of the system.

The above and yet other objects and advantages of the present invention will become apparent from the herein set forth Brief Description of the Drawings, Detailed Description of the Invention, and Claims appended herewith.

DETAILED DESCRIPTION OF THE INVENTION

Figure 1:
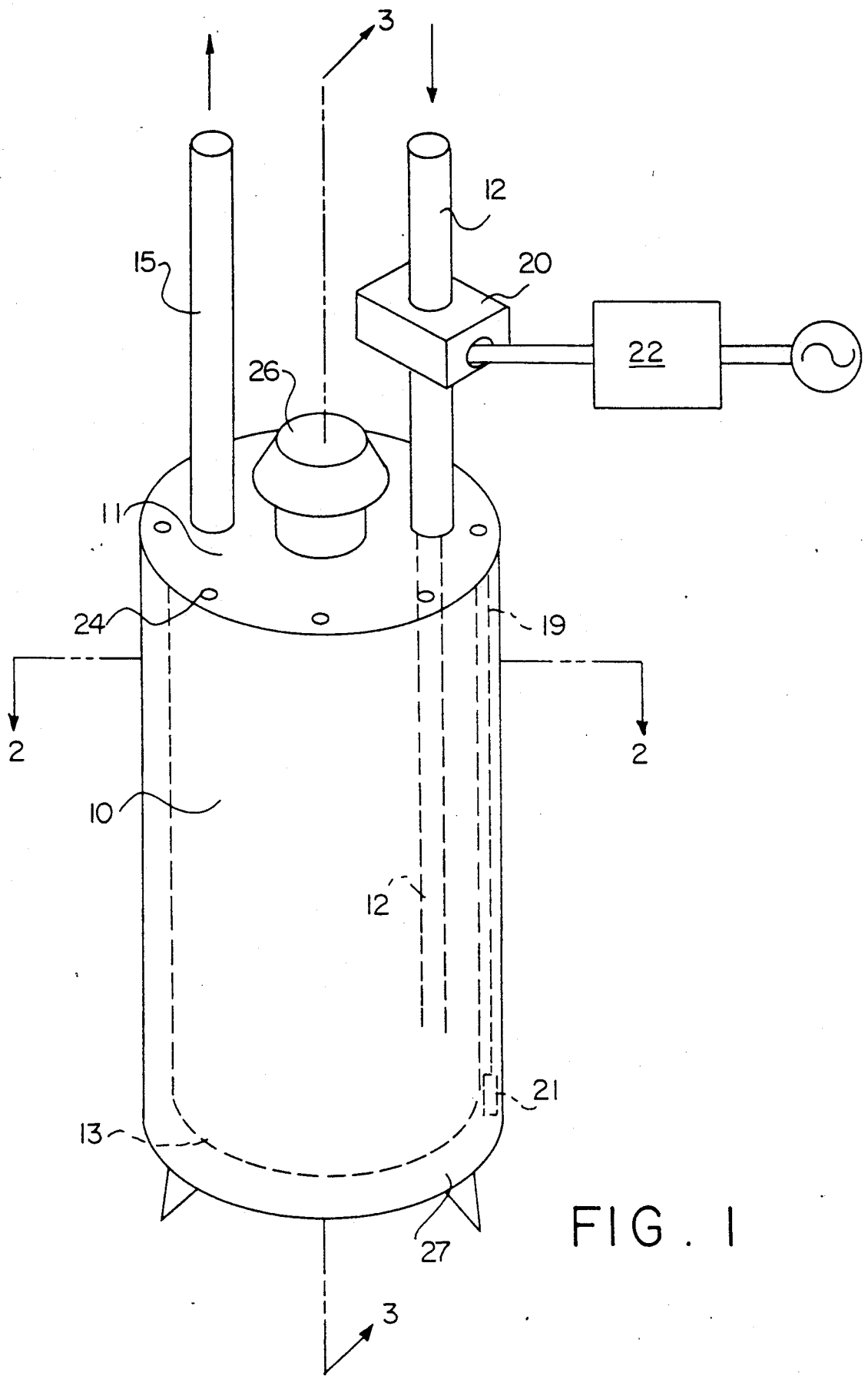
FIG. 1 is a perspective schematic view of a hot water vessel equipped with the inventive system.

With reference to the perspective view of FIG. 1, the inventive liquid vessel overflow control system is seen to include a vessel 10 having a liquid input 12 and a liquid output 15. In a typical water tank arrangement, input 12 will be a cold water line and output 15 will be a hot water line.

Said vessel 10 also includes top surface 11 and bottom surface 13.

Figure 2:
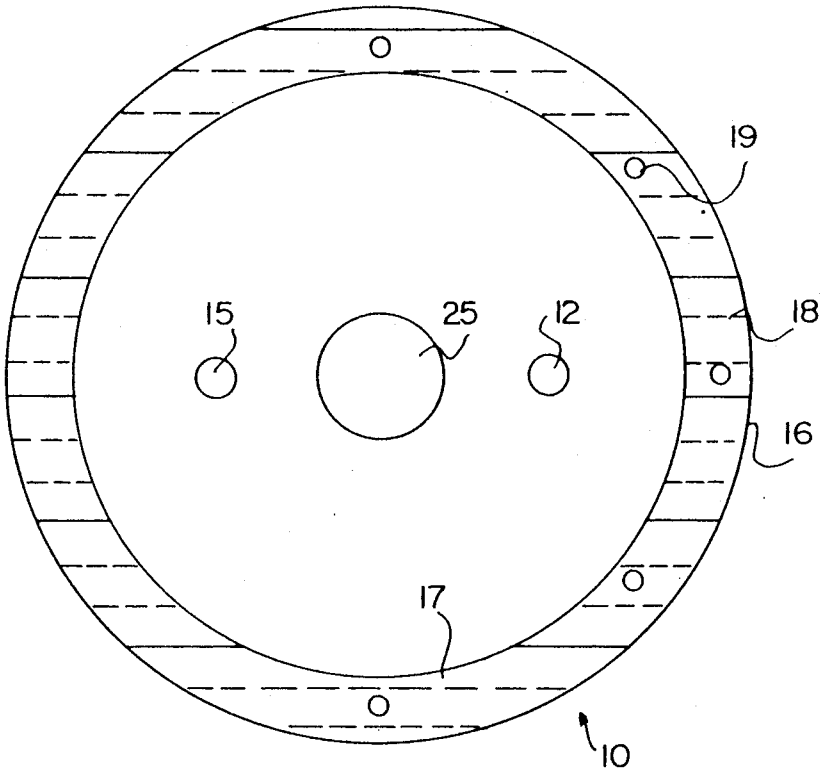
FIG. 2 is a radial cross-sectional view taken along Line 2—2 of FIG. 1.

With reference to the radial cross-sectional view of FIG. 2, the vessel 10 may be seen to include a fluid-tight peripheral housing 16 which peripherally surrounds vertical interior surface 17 of vessel 10. Also shown in the view of FIG. 2 is said liquid input 12, said liquid output 15 and a fluid gas exhaust pipe 25 which terminates in a flue gas exit 26 (See also FIG. 1).

Figure 3:
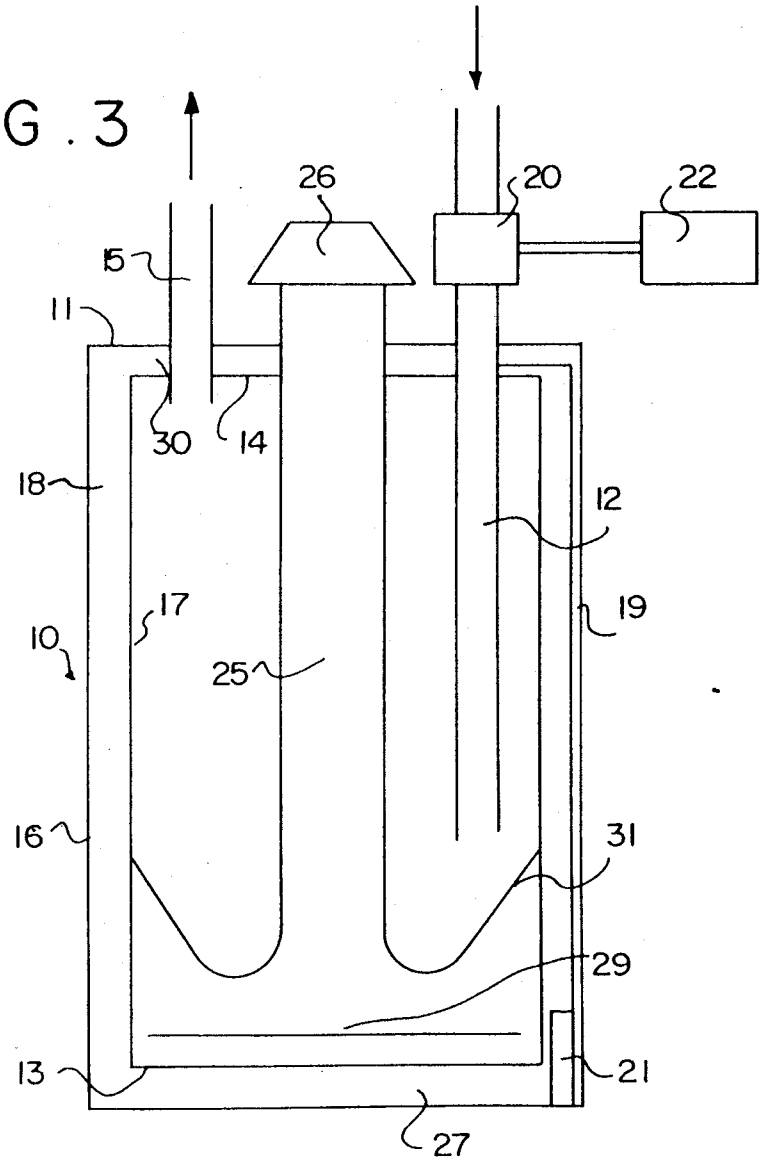
FIG. 3 is an axial, diametric, cross-sectional view taken along 3—3 of FIG. 1.

From the geometry of FIG. 2, it may be noted that an annular insulation region 18 is defined between vertical interior 17 an peripheral housing 16. Said region 18 is typically filled with a thermal insulating material. Also shown in the view of FIG. 2 is electrical communication means 19 which further shown in FIG. 3 and described below.

The inventive system further includes a liquid collection chamber 27 formed integrally beneath said vessel 10 and said housing 16. Said liquid collection chamber may be seen in the diametric axial cross-sectional view of FIG. 3 as, as well, may been seen a gas burner 29 and an internal glass linear 31. Thereby, the relationship between burner 29, flue pipe 25 and fluid exit 26 may been seen.

It is to be noted that said liquid collection chamber 27 will collect liquid or moisture resulting from a break in either the bottom 13 of vessel 10, or the vertical interior surface vessel 10.

It is also noted that top surface 11 is actually located above an interior top surface 14 such that moisture occurring as a result of a break in either input 12 or output 15 at a point above surface 11 will pass through weep holes 24 (See FIG. 1) and, therefrom, into a region 30 between said surfaces 11 and 14, into annular region 18 and therefrom into the liquid collection chamber 25. With further reference to the views of FIGS. 1 and 3, there is shown a fluid solenoid 20 fluidly disposed within said input 12 of the vessel. It is noted that said solenoid normally draws no current from a transformer 22 which, typically is an AC/DC transformer in which a typical line input of 120 volts AC, 5 amperes 60 HZ is converted into an output of between 12 and 24 volts DC, 1000 milliamperes. Accordingly, it is to be appreciated that said solenoid 20 is powered by a low voltage low current DC source and, further, by virtue of the structure of solenoid 22, will operate in a normally mechanically open position in which no current will be draw unless said solenoid is actuated by electrical communication 19, further described below.

Within said liquid collection chamber 27 is disposed liquid detection means 21 in the nature of a moisture sensor. Said liquid detection means comprise an element within electrical communication means 19 which comprises a part of an electrical circuit which includes said solenoid 20. As may be noted, the electrical communication 19 is mechanically protected by virtue of its enclosure within insulation region 18. Further, in the structure of the instant invention, the above defined circuit is a normally open circuit which will only become a closed, i.e., current-carrying circuit, when the circuit is closed responsive to a fixed level of liquid within chamber 27. Such a level of liquid must be sufficient to reach liquid detection sensor 21 thereby creating a closed circuit. When this occurs, current may flow through detection sensor 21, electrical communication means 19 and into solenoid 20, thereby actuating said solenoid to cause a mechanical blockage by an armature of the solenoid 20 of input 12. A solenoid suitable for use in the present application has been found to be a solenoid Model 3100 produced by Superior Valve Company, Valencia, CA 91355 having a pressure differential in the range of 10 to 150 psi between the input and output thereof.

The so-called positive shut-off of input 12 afforded by the above structure causes a vacuum effect within vessel 10, thereby maintaining the water level within said vessel.

As a result of the usage of a normally open solenoid which typically does not draw any current and, as well, the use of a DC low current transformer power source, the above described system will be safer than those known in the prior art during both normal operation and during emergency operation. Also the energy associated with prior art systems is saved.

It may be appreciated that the principles of the instant invention apply to many household appliances including, without limitation, hot water tanks and washing machines.

Accordingly, while there has been shown and described the preferred embodiment of the present invention, it is to be appreciated that the invention may be embodied otherwise than is herein shown and described and that, within said embodiment, certain changes may be made in the form and detail of the parts without departing from the underlying idea or principles of this invention within the scope of the claims appended herewith.

Having thus described our invention, what we claim as new, useful and non-obvious and, accordingly, secure by Letters Patent of the United States is:

1. A liquid vessel overflow control system, comprising:

(a) a vessel having a liquid input and liquid output, said vessel having a top and bottom defined by the gravity vector;

(b) a fluid-tight housing peripherally surrounding said vessel about all surfaces other than the bottom thereof, to thereby form an insulation region between said vessel and said housing;

(c) a liquid collection chamber formed integrally beneath said vessel and said housing, and in fluid communication with said insulation region in which a leak or fracture of said vessel will result in an accumulation of liquid in said collection chamber;

(d) a normally mechanically and electrically open electrically actuatable solenoid means disposed within said input of said vessel, said solenoid means normally drawing no current; and (e) liquid detection means disposed within said liquid collection chamber, said liquid detection means comprising an element within an electrical circuit having electrical communication means disposed between said solenoid means and said liquid detection means and extending along the length of said housing and said vessel within said insulating region, said liquid detection means further comprising a normally open circuit, whereby, said liquid detection means will become a closed circuit responsive to a fixed level of liquid within said liquid collection chamber, thereby permitting current flow to said solenoid means to actuate said means, thereby blocking further input of liquid to said vessel.

2. The system as recited in claim 1 in which said solenoid means includes DC power input means.

3. The system as recited in claim 2 in which said DC power input means comprises transformer means utilizing AC line voltage as the input thereto.

4. The system as recited in claim 3 in which said solenoid means comprises differential pressure closure capacity in the range of about 10 psi to about 150 psi.

5. The system as recited in claim 3 in which said insulation region comprises thermal insulation means.

6. The system as recited in claim 5 in which said insulation region further comprises electrical insulation means.

7. The system as recited in claim 3 in which said vessel comprises a hot water tank.

8. The system as recited in claim 3 in which said vessel comprises an automatic clothes washer.

* * * * *